US009115950B2

(12) United States Patent
Bethlenfalvy

(10) Patent No.: US 9,115,950 B2
(45) Date of Patent: Aug. 25, 2015

(54) FIREARM SUPPRESSOR

(71) Applicant: Aaron Marcus Bethlenfalvy, Southbury, CT (US)

(72) Inventor: Aaron Marcus Bethlenfalvy, Southbury, CT (US)

( * ) Notice: Subject to any disclaimer, the term of this patent is extended or adjusted under 35 U.S.C. 154(b) by 0 days.

(21) Appl. No.: 14/254,593

(22) Filed: Apr. 16, 2014

(65) Prior Publication Data

US 2014/0353076 A1 Dec. 4, 2014

Related U.S. Application Data

(60) Provisional application No. 61/830,388, filed on Jun. 3, 2013.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 7,735,406 | B1 * | 6/2010 | Olson | 89/14.3 |
| 8,162,100 | B2 * | 4/2012 | Shults et al. | 181/223 |
| 8,167,084 | B1 * | 5/2012 | Moore | 181/223 |
| 2011/0061966 | A1 * | 3/2011 | Brittingham | 181/223 |
| 2011/0186377 | A1 * | 8/2011 | Kline et al. | 181/223 |
| 2012/0279381 | A1 * | 11/2012 | Landolt | 89/14.4 |

* cited by examiner

*Primary Examiner* — Forrest M Phillips

(57) ABSTRACT

A firearm suppressor is provided. The firearm suppressor includes an outer body having an inner portion. A noise suppressor component is within the outer body of the firearm suppressor. The outer body may include a front portion, a rear portion, and a channel running from the front portion to the rear portion. The present invention may further include an accessory rail protruding from the outer body of the firearm suppressor.

9 Claims, 5 Drawing Sheets

FIREARM SUPPRESSOR

CROSS-REFERENCE TO RELATED APPLICATION

This application claims the benefit of priority of U.S. provisional application Ser. No. 61/830,388, filed Jun. 3, 2013, the contents of which are herein incorporated by reference.

BACKGROUND OF THE INVENTION

The present invention relates to a firearm suppressor and, more particularly, to a firearm suppressor with an accessory rail.

When using a sound suppressor on a firearm the user often has difficulty aiming the weapon and holding the weapon on target for an extended period of time. A firearm which cannot be properly aimed and causes user fatigue can be dangerous if discharged in an undesired direction. The result can lead to unintended damage, bodily harm or even death. Further, current suppressors cannot be disassembled for cleaning without specialty tools and a user cannot hold the suppressor after shooting due to excessive heat.

The inability to use accessories on suppressors significantly reduces the user's level of stability, accuracy and control of the firearm. The inability to perform routine maintenance allows residual buildup inside the suppressor, increasing the chances of catastrophic failure and/or bodily harm to the user. Poor heat dissipation increases the chances of burns and/or accidental discharge of the firearm.

Suppressor manufacturers struggle to reduce decibel levels due to overall size restrictions (so as to not block the firearm iron sights) and improper manipulation of gasses. Alignment of non-round suppressors has been accomplished with complicated indexing mechanical features which add to the complexity/cost of the device. The higher level of decibels may cause hearing damage to the user and/or those around him/her. Mechanical failure of mechanical cam lever locks for indexing could lead to an inoperable suppressor.

As can be seen, there is a need for an improved firearm suppressor with a rail system.

SUMMARY OF THE INVENTION

In one aspect of the present invention, an apparatus comprises: an outer body comprising an inner portion having a noise suppressor component within, wherein the outer body comprises a front portion, a rear portion, and a channel running from the front portion to the rear portion, wherein the rear portion is attachable to a firearm barrel, the outer body comprising a top side, a bottom side, a first side and a second side; and an accessory rail protruding from at least a portion of at least one of the top side, the bottom side, the first side and the second side.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an improved firearm suppressor. The exterior shape of a suppressor includes an accessory mounting feature molded, welded or bonded to the exterior of the suppressor. The present invention may further include a compression assembly with a single disassembly point to allow for quick/efficient disassembly of the suppressor for cleaning. Multiple heat exchange risers on the suppressor body may dissipate heat. A progressive gas release connecting rod combined with multi cavity gas manipulation slows and cools gas release, reducing decibel levels. A male/female relationship between the piston and blast chamber combined with the tension of a spring offers simplistic/cost effective indexing of non-round suppressors.

The present invention enables the user to attach accessories to the suppressor which assists in firearm stability, accuracy, and control. For example, accessories such as laser sights, flashlight, fore-grip, sling mounts, bipod, and the like may be attached via the accessory mount attached to the suppressor body. The present invention enables the user to perform cleaning maintenance without the use of specialty tools. The present invention increases heat dissipation through the heat exchangers built into the suppressor body which keeps the suppressor cool even after rapid fire. The present invention reduces decibel levels by allowing quick release of gasses close to the barrel, channeling it into an enlarged lower cavity and limiting the gas escape through the end of the suppressor. The present invention allows for quick, cost effective indexing of non-round suppressors.

Figure 1:
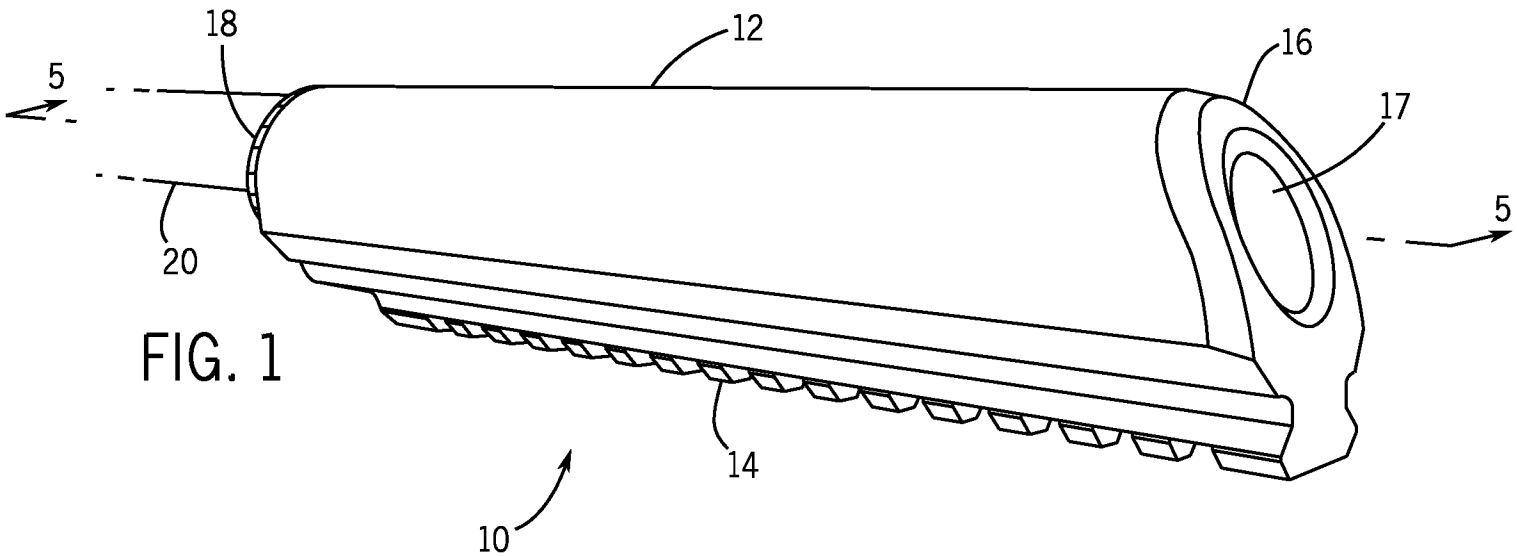
FIG. 1 is a perspective view of the present invention.
Figure 2:
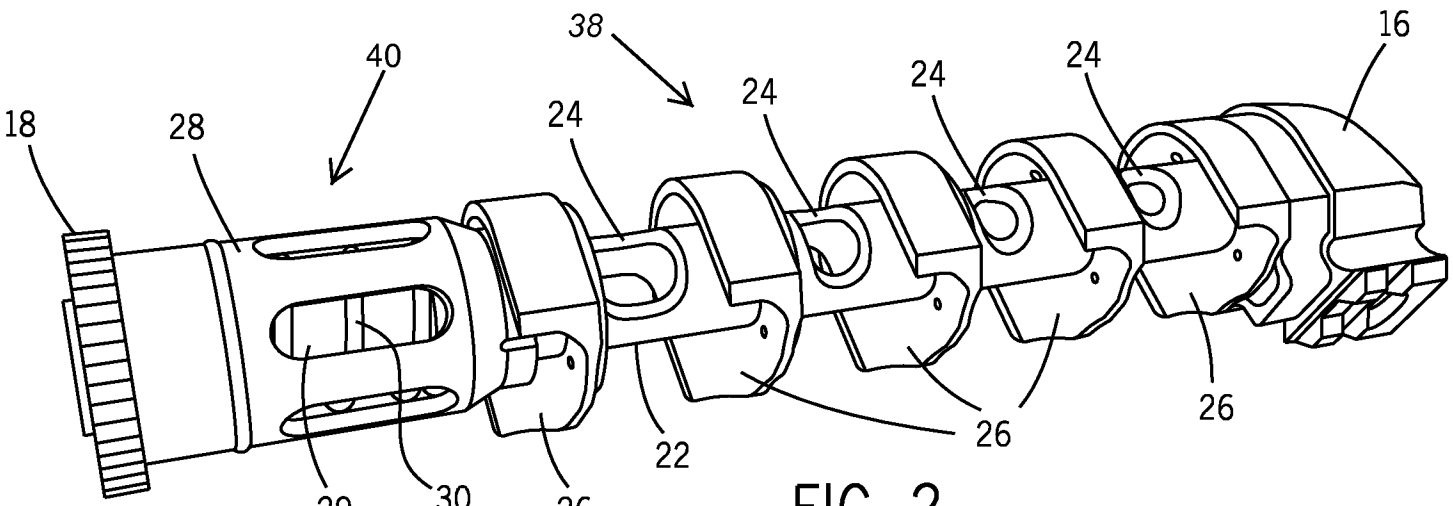
FIG. 2 is a perspective view showing inner components of the present invention.
Figure 3:
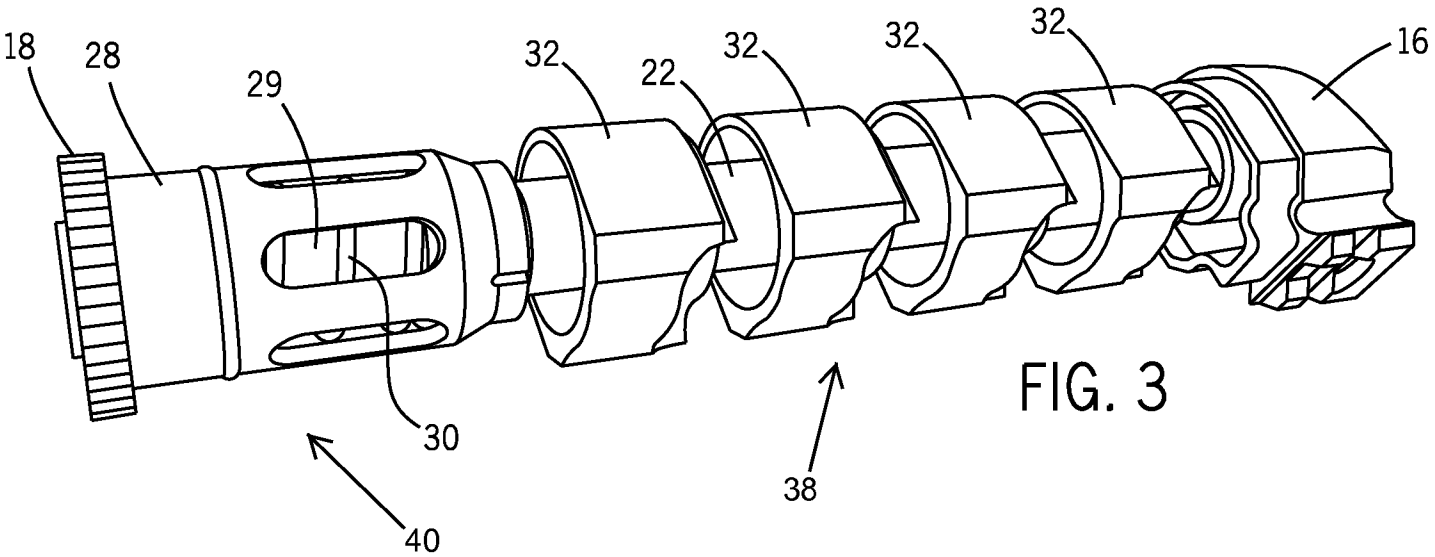
FIG. 3 is another perspective view showing inner components of the present invention.
Figure 4:
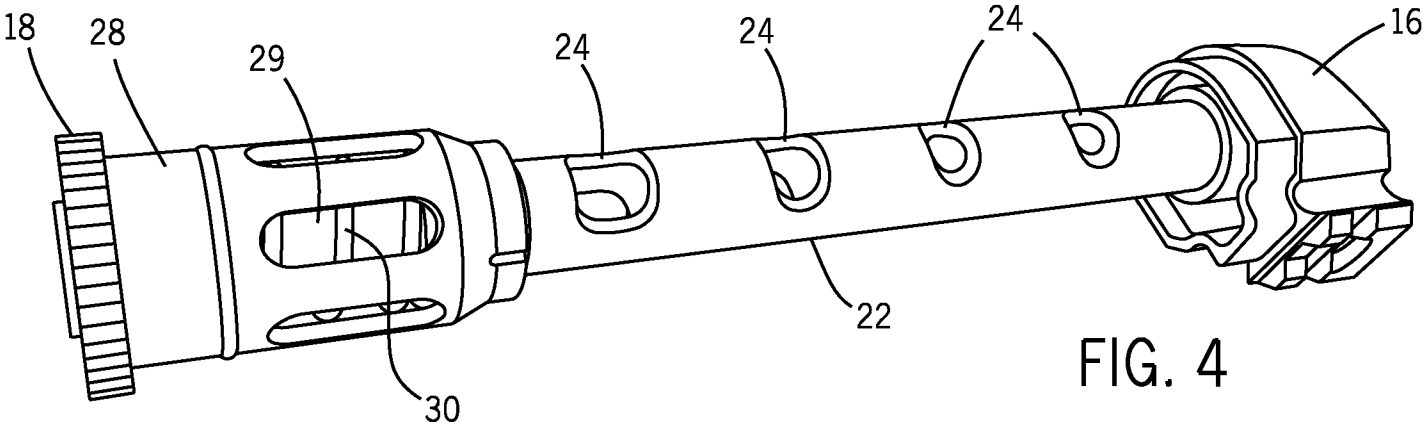
FIG. 4 is another perspective view showing innermost components of the present invention.
Figure 5:
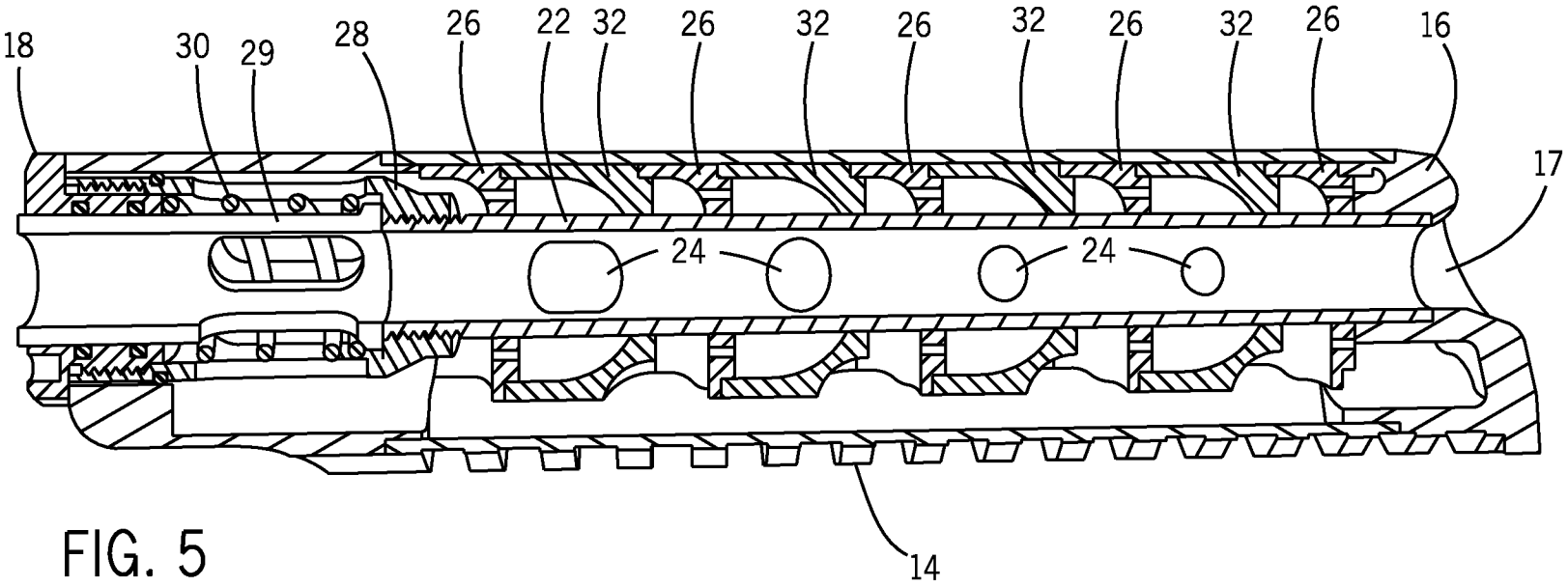
FIG. 5 is a cross-sectional view taken along line 5-5 of FIG. 1.
Figure 6:
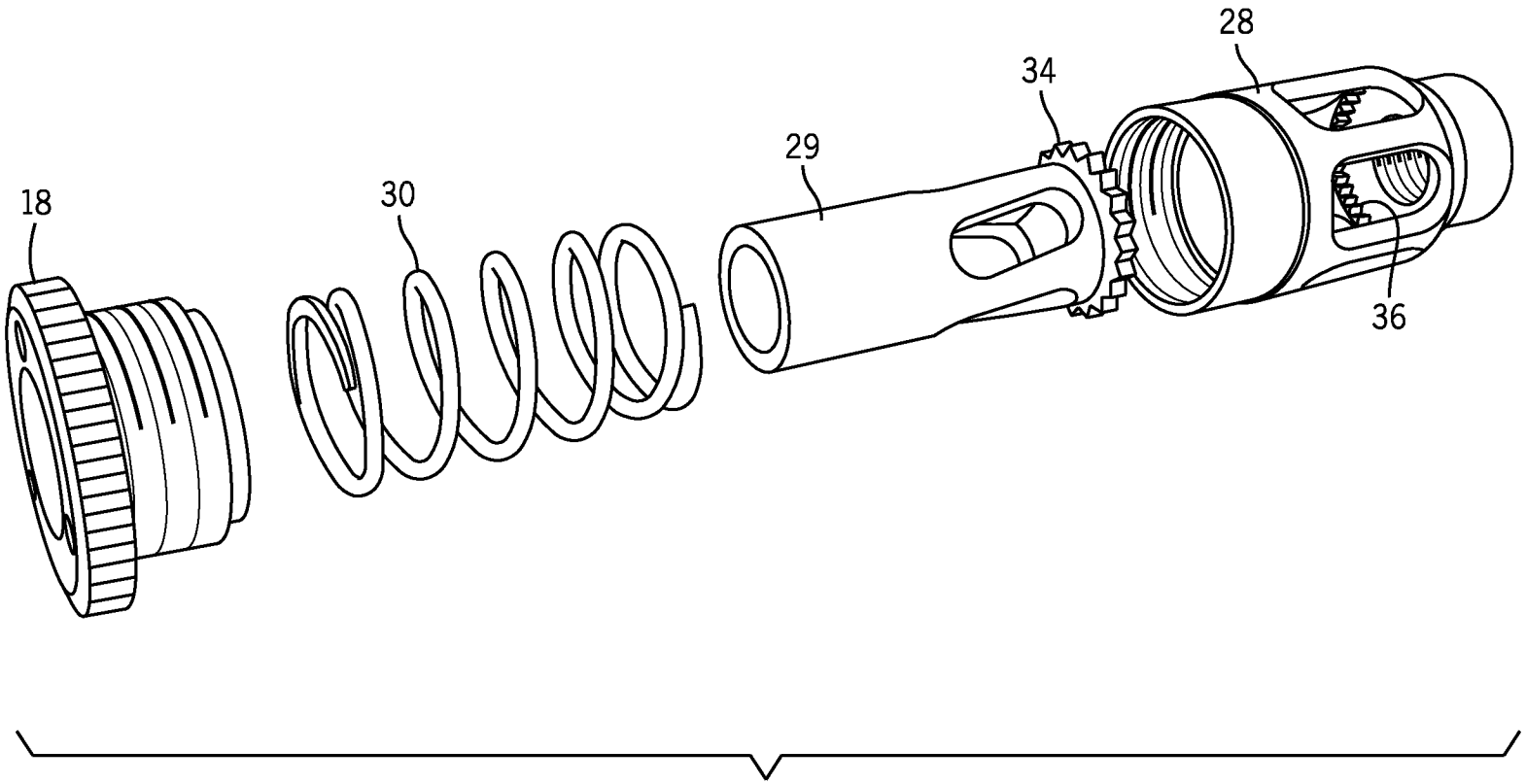
FIG. 6 is a detail exploded perspective view of on indexing component the present invention.
Figure 7:
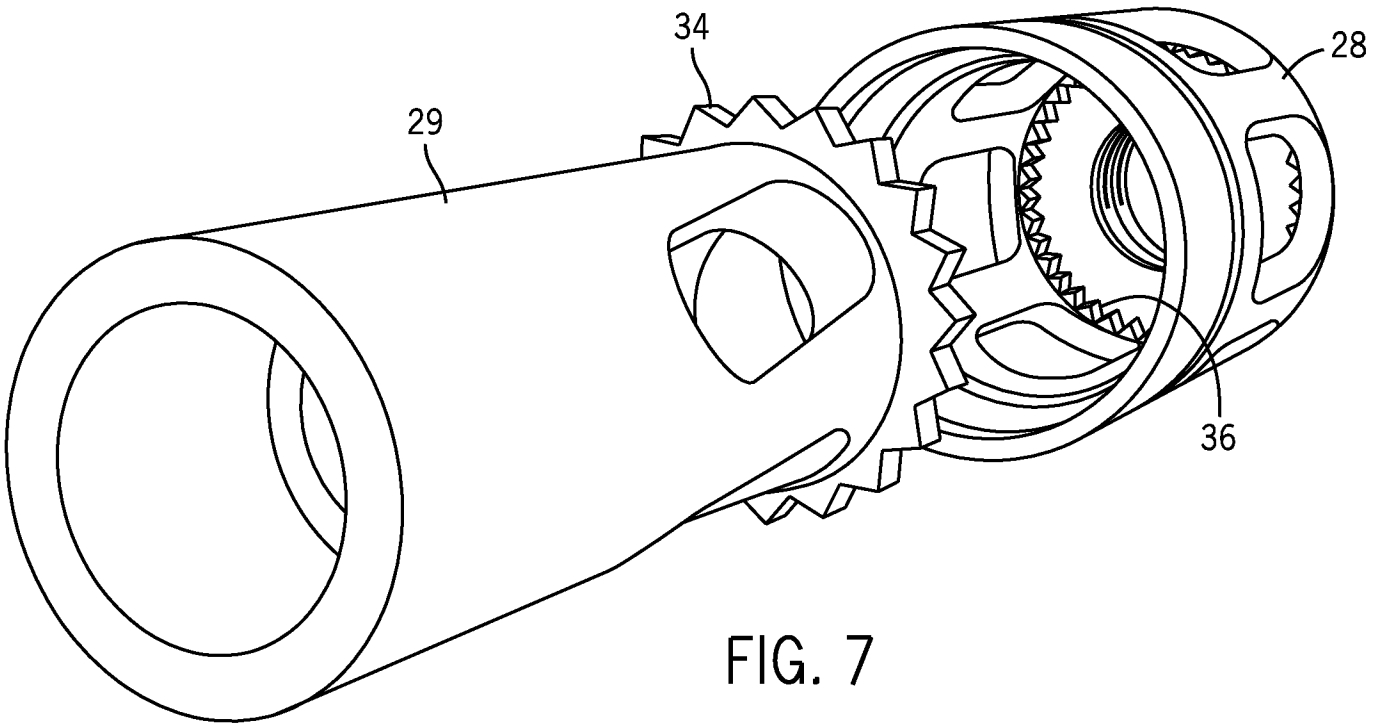
FIG. 7 is another detail exploded perspective view of the present invention.

Referring to FIGS. 1 through 7, the present invention includes a firearm suppressor 10. The firearm suppressor 10 includes an outer body 12 having an inner portion. A noise suppressor component 38 is within the outer body 12 of the firearm suppressor 10. The outer body 12 may further include a front portion, a rear portion, and a channel running from the front portion to the rear portion. The rear portion is attachable to a firearm barrel 20. The front portion may include the discharge port 17 for the bullet. Therefore, the bullet from the gun travels through the channel and out of the discharge port 17.

The outer body 12 may further include a top side, a bottom side, a first side, and a second side. An accessory rail 14 may protrude from at least a portion of the top side, the bottom side, the first side, and/or the second side. The accessory rail 14 may be bonded, welded, brazed or otherwise affixed to the outer body 12. As illustrated in the Figures, the accessory rail 14 may protrude from a substantial portion of the bottom side of the outer body 12. In certain embodiments, the accessory rail 14 may be a Picatinny rail. In certain embodiments, the accessory rail 14 may act as a heat exchange riser.

In certain embodiments, the present invention may include an indexing component 40 and the noise suppressor component 38 within the inner portion of the outer body 12. The noise suppressor component 38 may be attached to the indexing component 40. The indexing component 40 may include a blast chamber 28 having an opening leading into an inner cavity. The blast chamber 28 may further include a front end that is attachable to the noise suppressor component 38. The indexing component 40 may further include a piston 29 having a hollow center. The piston 29 fits within the inner cavity of the blast chamber 28. A spring 30 may fit around the piston 29 and may fit within the indexing component 40. A cap 18 may cover the opening of the blast chamber 28 and thereby secure the piston 29 and spring 30 within the blast chamber 28.

The bullet from the firearm barrel 20 may travel through an opening in the cap 18, through the piston 29 and through the front end of the blast chamber 28 into the noise suppressor component 38. The cap 18 is attachable to the firearm barrel 20. In certain embodiments, the end of the piston 29 may have a plurality of piston teeth 34, and the blast chamber 28 may include a plurality of blast chamber teeth 36 near the front end of the blast chamber 28. The piston teeth 34 and the blast chamber teeth 36 may mate and interlock. The spring 30 may bias the piston 29 towards the front end of the blast chamber 28. Therefore, the spring 30 may bias the piston 29 and the blast chamber 28 in a locked position relative to one another. However, to index the firearm suppressor 10, a user may pull the firearm suppressor 10 so that the teeth 34, 36 are in an unlocked position, so that the outer body 12 may be rotated relative to the gun and the accessory rail 14 may be placed in a desirable position.

In certain embodiments, the noise suppressor component 38 may be a standard noise suppressor. However, in certain embodiments, the noise suppressor component 38 may include a gas release rod 22 having a front end and a rear end. The gas release rod 22 may include a plurality of gas release apertures 24 along the length. The plurality of gas release apertures 24 may increase in size from the front end towards the rear end. A plurality of baffles 32 may be attached to the gas release rod 22 and cover the plurality of gas release apertures 24. In certain embodiments, a plurality of exhaust baffles 26 may be attached in between the baffles 32. In certain embodiments, the baffles 26, 32 may slide over the gas release rod 22 in series until there are a total of five exhaust baffles 26 and four baffles 32. The baffles 26, 32 form gas pockets within, and thereby suppress the noise of the gun shot.

As mentioned above, embodiments of the present invention may be easily taken apart and cleaned. As illustrated in the Figures, the cap 18 and the blast chamber 28 may include mating threaded portions that may easily be screwed and unscrewed. The front end of the rear end of the gas release rod 22 and the front end of the blast chamber 28 may include mating threaded portions that may be easily screwed and unscrewed. In certain embodiments, the present invention may further include an end cap 16 that is releasably attachable to the front portion of the outer body 12. The front end of the gas release rod 22 may be attached to the end cap 16. Therefore, the end cap 16 and the gas release rod 22 may be easily pulled out of the outer body 12 and cleaned.

When the suppressor 38 is assembled with a progressive gas release connector rod 22, baffles 32 and exhaust baffles 26, the sound of the firearm explosion is reduced by trapping, cooling and slowly releasing the rapidly expanding gasses of the explosion. When attaching the firearm suppressor 10 to a firearm, the user may index it properly for even weight distribution. This is accomplished by pulling the indexing component 40 away from the firearm, twisting to the desired location and releasing tension. The suppressor piston 29 may align with teeth 36 in the blast chamber 28 and may lock together under the pressure of the spring 30, keeping the outer body 12 properly indexed. The accessory mounting rail 14 on the outer body 12 will enable use of accessory sights to improve accuracy, use of a fore-grip to improve firearm stability, use of flashlight or IR light for night visibility, and use of sling mount for greater control during transport. In certain embodiments, the accessory mounting rail 14 may be split into independent right and left rails to increase surface area and act as a heat sink to dissipate heat from the firearm suppressor 10.

A method of making the present invention may include the following. A custom extruded shape may create the extrusion body. Post machined slots in the extrusion may reduce weight and enable common attachments to pass from side to side of the suppressor clamping down on the extruded shape. Machined, cast or forged baffles may be inserted into the extrusion body on top of the progressive gas release rod. Machined, cast or forged exit plugs may press, screw of otherwise affix into the ends of the extrusion body. A machined or turned progressive gas release rod may connect both end caps to the extrusion body. Both the piston and blast baffle can be machined, cast or forged.

A method of using the present invention may include the following. Install the suppressor onto your firearm. Index the suppressor so that the accessory rail is facing 6 o'clock (straight down). To do this pull the suppressor away from the firearm while twisting it to the desired location. Once twisted to the desired location release the tension and the suppressor may stay in the desired location. Attach any of the thousands of accessories available on the market. Unscrew the accessory mounting screw to loosen the compression plates. Slide the accessory over the integrated accessory mount on the suppressor to the desired position. Tighten the accessory mounting screw(s) to the manufacturers recommended torque setting. Begin using your firearm with suppressor mounted accessories. The suppressor may be cleaned after every 250 rounds. To clean the internal components, remove the suppressor from the firearm. Unscrew the rear retaining cap, remove the piston and spring, slide off the rear cap, tap lightly on the blast chamber with a non marring device until the front cap decouples from the extrusion body. Slide the front cap and baffle stack out of the extrusion body. Remove and clean each baffle and exhaust baffle. Clean the connector tube with bore cleaning solution and wipes. This invention can be used on firearms, paintball suppression devices, as well as, children's toy firearms such as cap guns, water guns, etc.

It should be understood, of course, that the foregoing relates to exemplary embodiments of the invention and that modifications may be made without departing from the spirit and scope of the invention as set forth in the following claims.

What is claimed is:

1. An apparatus comprising:

an outer body comprising an inner portion a front portion, a rear portion, and a channel running from the front portion to the rear portion, wherein the rear portion is attachable to a firearm barrel, the outer body comprising a top side, a bottom side, a first side and a second side;

a noise suppressor component within the inner portion of the outer body;

an indexing component operable to rotate the outer body relative to the firearm barrel, wherein the indexing component comprises: a blast chamber comprising an inner cavity and a front end comprising a plurality of internal blast chamber teeth, wherein the front end is attached to the noise suppressor component; a piston comprising a plurality of piston teeth and disposed within the inner cavity of the blast chamber; and a spring biasing the plurality of piston teeth to mate with the plurality of internal blast chamber teeth; and an accessory rail protruding from at least a portion of at least one of the top side, the bottom side, the first side and the second side.

2. The apparatus of claim 1, wherein the accessory rail is protruding from a substantial portion of the bottom side of the outer body.

3. The apparatus of claim 1, wherein the accessory rail is a Picatinny rail.

4. The apparatus of claim 1, wherein the outer body comprises at least one heat exchange riser.

5. The apparatus of claim 1, wherein the noise suppressor component comprises:

a gas release rod comprising a plurality of gas release apertures along the length of the gas release rod; and a plurality of baffles attached to the gas release rod, wherein the baffles form gas pockets within.

6. The apparatus of claim 5, wherein the gas release rod comprises a front end near the front portion of the outer body and a rear end towards the rear portion of the outer body.

7. The apparatus of claim 6, wherein the plurality of gas release apertures increase in size from the front end towards the rear end.

8. The apparatus of claim 6, further comprising an end cap attached to the front end of the gas release rod and releasably attachable to the front portion of the outer body.

9. The apparatus of claim 6, wherein the rear end of the gas release rod is releasably attachable to the indexing component.

* * * * *